US010170876B2

(12) United States Patent
Quam et al.

(10) Patent No.: US 10,170,876 B2
(45) Date of Patent: Jan. 1, 2019

(54) ELECTRICAL CONNECTORS HAVING A PLURALITY OF PINS AND SOCKETS

(71) Applicant: Schlumberger Technology Corporation, Sugar Land, TX (US)

(72) Inventors: Erik Quam, Sugar Land, TX (US); Shelby W. Carter, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 15/286,446

(22) Filed: Oct. 5, 2016

(65) Prior Publication Data

US 2018/0097305 A1 Apr. 5, 2018

(51) Int. Cl.
*H01R 24/00* (2011.01)
*H01R 33/00* (2006.01)

(52) U.S. Cl.
CPC ..... *H01R 24/00* (2013.01); *H01R 23/02* (2013.01)

(58) Field of Classification Search
CPC ..... H01R 13/04; H01R 13/10; H01R 13/64; H01R 24/00; H01R 33/00; H01R 23/02
USPC ..... 439/65, 680, 59, 660
See application file for complete search history.

(56) References Cited

U.S. PATENT DOCUMENTS 5,975,921 A * 11/1999 Shuey ..... H01R 12/724 174/263
6,443,745 B1 * 9/2002 Ellis ..... H01R 23/688 439/101
6,669,488 B2 * 12/2003 Kaller ..... H01R 12/57 439/69
6,866,521 B1 * 3/2005 Harper, Jr. ..... H01R 12/716 439/71
7,896,683 B1 * 3/2011 Ratzlaff ..... H01R 13/631 439/374
8,684,768 B2 * 4/2014 Huang ..... H01R 12/724 439/541.5
2008/0045052 A1 * 2/2008 Coteus ..... G11C 5/04 439/79
2009/0221187 A1 * 9/2009 Daly ..... H01R 9/2491 439/660
2010/0197149 A1 * 8/2010 Davis ..... H01R 12/727 439/59
2010/0244871 A1 * 9/2010 Blair ..... G01R 1/07378 324/756.05
2011/0207342 A1 * 8/2011 Davis ..... H01R 12/724 439/65

* cited by examiner

*Primary Examiner* — Chandrika Prasad
(74) *Attorney, Agent, or Firm* — Trevor G. Grove

(57) ABSTRACT

Plugs, receptacles, and assemblies including same. The plug can include an interface having a plurality of pins extending therefrom. The plug can have a plug density of at least 280 pins/in$^2$. The plurality of pins can be positioned in at least three rows along a longitudinal axis of the interface. The receptacle can have an interface having a plurality of sockets disposed therein. The receptacle can have a receptacle density of at least 280 sockets/in$^2$. The plurality of sockets can be positioned in at least three rows along a longitudinal axis of the interface.

18 Claims, 3 Drawing Sheets

ELECTRICAL CONNECTORS HAVING A PLURALITY OF PINS AND SOCKETS

BACKGROUND

Field

Embodiments described generally relate to electrical connectors and assemblies including same.

Description of the Related Art

Standard-D electrical connectors, Micro-Miniature electrical connectors, and Nano-Miniature electrical connectors can be mechanically robust and durable to meet the demanding applications and harsh environments in which the electrical connectors may be exposed. The electrical connectors can be utilized in applications where space may be at a premium and can be suited to a multitude of systems. For example, the electrical connectors can be used in missiles and their guidance systems, aerospace avionics, radar systems, shoulder-launched weapon systems, advanced soldier technology systems, military Global Positioning Systems, satellites, medical devices, and down-hole tools.

SUMMARY

Plugs, receptacles, and electrical connector assemblies are provided herein. In some examples, the plug can include an interface having a plurality of pins extending therefrom. The plug can have a plug density of at least 280 pins/in$^2$. The plurality of pins can be positioned in at least three rows along a longitudinal axis of the interface.

In some examples, the receptacle can include an interface having a plurality of sockets disposed therein. The receptacle can have a receptacle density of at least 280 sockets/in$^2$. The plurality of sockets can be positioned in at least three rows along a longitudinal axis of the interface.

In some examples, the electrical connector assembly can include a plug and a receptacle. The plug can include a first interface having a plurality of pins extending therefrom. The plug can have a plug density of at least 280 pins/in$^2$. The plurality of pins can be positioned in at least three rows along a longitudinal axis of the first interface. The receptacle can include a second interface having a plurality of sockets disposed therein. The receptacle can have a receptacle density of at least 280 sockets/in$^2$. The plurality of sockets can be positioned in at least three rows along a longitudinal axis of the second interface.

DETAILED DESCRIPTION

Figure 1:
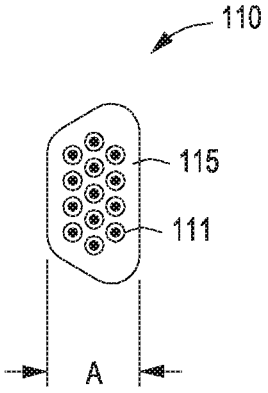
FIGS. 1-6 depict plan views of illustrative Micro-Miniature-D plugs having 13, 22, 31, 37, 46, and 55 pins, respectively, extending from an interface thereof, according to one or more embodiments described.
Figure 2:
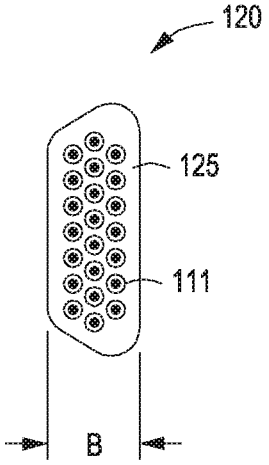
Figure 3:
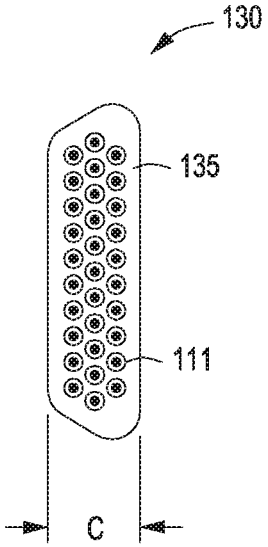
Figure 4:
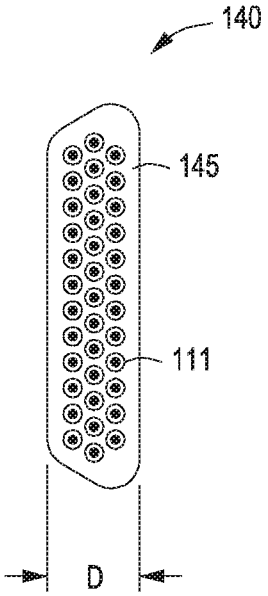
Figure 5:
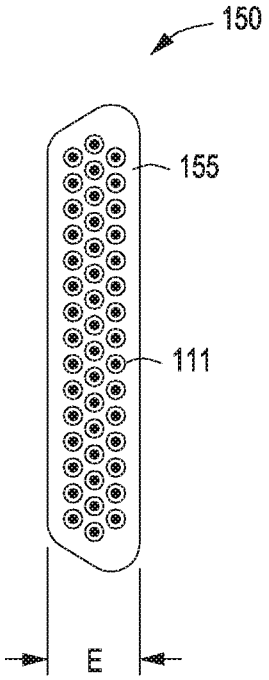
Figure 6:
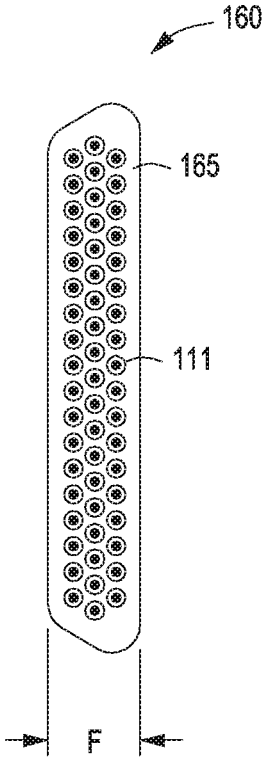

Certain examples are shown in the above-identified figures and described in detail below. In describing these examples, like or identical reference numbers are used to identify common or similar elements. The figures are not necessarily to scale and certain features and certain views of the figures may be shown exaggerated in scale or in schematic for clarity and/or conciseness.

FIGS. 1-6 depict plan views of illustrative Micro-Miniature-D ("Micro-D") plugs 110, 120, 130, 140, 150, and 160, respectively, according to one or more embodiments. The plugs 110, 120, 130, 140, 150, and 160 can include an interface 115, 125, 135, 145, 155, and 165, respectively, that can include a plurality of pins 111 extending therefrom. For example, as shown in FIGS. 1-6, the Micro-D plugs 110, 120, 130, 140, 150, and 160 can include thirteen (13), twenty-two (22), thirty-one (31), thirty-seven (37), forty-six (46), and fifty-five (55) pins 111, respectively. The plurality of pins 111 can be arranged in three, four, five, six, or more rows along a longitudinal axis of the interface 115, 125, 135, 145, 155, and/or 165. In some examples, the plurality of pins 111 can be arranged in three, four, five, six, or more substantially parallel or parallel rows along a longitudinal axis of the respective interface 115, 125, 135, 145, 155, and/or 165. The number of pins 111 in any two adjacent rows can be the same or different with respect to one another.

In some examples, the number of pins 111 in a plug, e.g., the plugs 110, 120, 130, 140, 150, and 160, that includes three rows of pins 111 along the longitudinal axis thereof, can correspond to the following equation: $A_{3\text{-}row}=P_{2\text{-}row}+((P_{2\text{-}row}-1)/2)$, where $A_{3\text{-}row}$ is the number of pins in a plug having three rows, and where $P_{2\text{-}row}$ is the number of pins in a standard connector having two rows of pins and defined according to MIL-DTL-83513/3J w/Amendment 1: Dec. 14, 2011 (Class M) or MIL-DTL-83513/8F w/Amendment 1: Dec. 14, 2011 (Class P). In other examples, the number of pins in a plug that includes four rows of pins 111 along the longitudinal axis thereof can correspond to the following equation: $A_{4\text{-}row}=(4\ P_{3\text{-}row})/3)$, where $A_{4\text{-}row}$ is the resulting number of pins in a plug having four rows, and where $P_{3\text{-}row}$ is the number of pins in a standard connector having three rows of pins and defined according to MIL-DTL-83513/3J w/Amendment 1: Dec. 14, 2011 (Class M) or MIL-DTL-83513/8F w/Amendment 1: Dec. 14, 2011 (Class P). In other examples, the number of pins in a plug that includes five rows of pins 111 along the longitudinal axis thereof can correspond to the following equation: $A_{5\text{-}row}=P_{4\text{-}row}+((P_{4\text{-}row}-1)/2)$, where $A_{5\text{-}row}$ is the resulting number of pins in a plug having five rows, and where $P_{4\text{-}row}$ is the number of pins in a standard connector having four rows of pins and defined according to MIL-DTL-83513/3J w/Amendment 1: Dec. 14, 2011 (Class M) or MIL-DTL-83513/8F w/Amendment 1: Dec. 4, 2011 (Class P).

In some examples, the plugs 110, 120, 130, 140, 150, and 160 having at least three rows of pins 111, as depicted in FIGS. 1-6, can have a plug area of about 0.05 $in^2$, about 0.1 $in^2$, about 0.12 $in^2$, about 0.14 $in^2$, about 0.16 $in^2$, or about 0.18 $in^2$ to about 0.2 $in^2$, about 0.4 $in^2$, about 0.6 $in^2$, about 0.8 $in^2$, about 1 $in^2$, about 2 $in^2$, about 3 $in^2$, about 4 $in^2$, about 5 $in^2$, or more. In some examples, the plugs 110, 120, 130, 140, 150, and 160 having at least three rows of pins 111 can have a plug density of at least 240 pins/$in^2$, at least 255 pins/$in^2$, at least 270 pins/$in^2$, at least 280 pins/$in^2$, about 284 pins/$in^2$, about 290 pins/$in^2$, about 297 pins/$in^2$, or about 301 pins/$in^2$ to about 305 pins/$in^2$, about 310 pins/$in^2$, about 315 pins/$in^2$, about 320 pins/$in^2$ or more. It should be noted that the shape or configuration of the plug interfaces 115, 125, 135, 145, 155, and 165 can also correspond to various other plugs, including, but not limited to Nano-Miniature plugs, e.g., nano-D plugs. It should also be noted that the plug interfaces 115, 125, 135, 145, 155, and 165 can also correspond to various other plugs that are not defined according to a military standard specification, but can be defined according to "non-military standard" specifications.

In other examples, a plug having at least four rows of pins can have at least twenty-four (24) pins, at least thirty-six (36) pins, at least sixty-eight (68) pins, or at least ninety-two (92) pins. The plug having at least four rows of pins can have a plug area of about 0.05 $in^2$, about 0.08 $in^2$, about 0.11 $in^2$, or about 0.2 $in^2$ to about 0.27 $in^2$, about 0.5 $in^2$, about 1 $in^2$, about 2 $in^2$, about 3 $in^2$, or more. The plugs can have a plug density of at least 280 pins/$in^2$, about 284 pins/$in^2$, about 292 pins/$in^2$, about 303 pins/$in^2$ or about 310 pins/$in^2$ to about 315 pins/$in^2$, about 320 pins/$in^2$, about 324 pins/$in^2$, 331 pins/$in^2$ or more.

In other examples, a plug having at least five rows of pins can have about fifty-nine (59) pins, about one hundred twenty-nine (129) pins, or more. The plugs can have a plug area of about 0.17 $in^2$, about 0.36 $in^2$, about 0.5 $in^2$, about 1 $in^2$, or about 1.5 $in^2$ to about 2 $in^2$, about 2.5 $in^2$, about 3 $in^2$, about 3.5 $in^2$, or more. The plugs can have a plug density of at least 280 pins/$in^2$, about 310 pins/$in^2$, or about 320 pins/$in^2$ to about 332 pins/$in^2$, about 340 pins/$in^2$, about 351 pins/$in^2$, or more.

Figure 7:
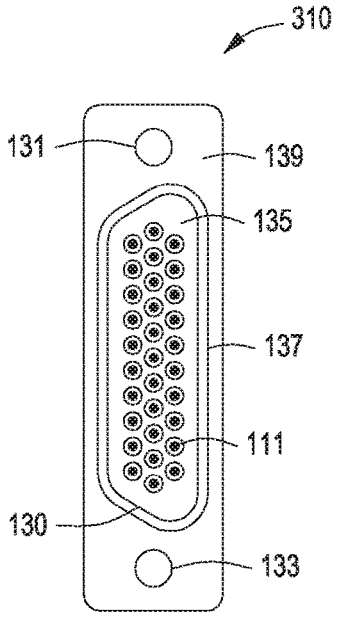
FIG. 7 depicts a plan view of an illustrative Micro-Miniature-D plug coupled to a faceplate, according to one or more embodiments described.
Figure 8:
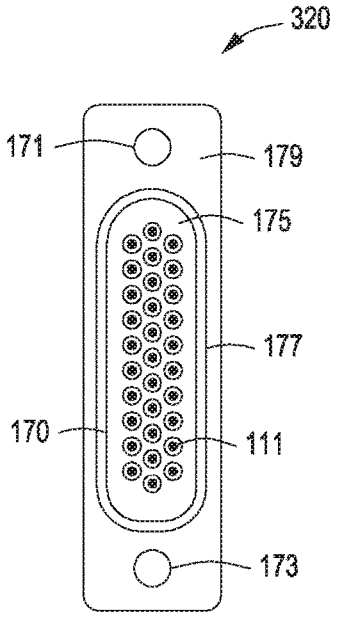
FIG. 8 depicts a plan view of an illustrative Micro-Miniature plug coupled to a faceplate and having an arrow-shaped interface, according to one or more embodiments described.
Figure 9:
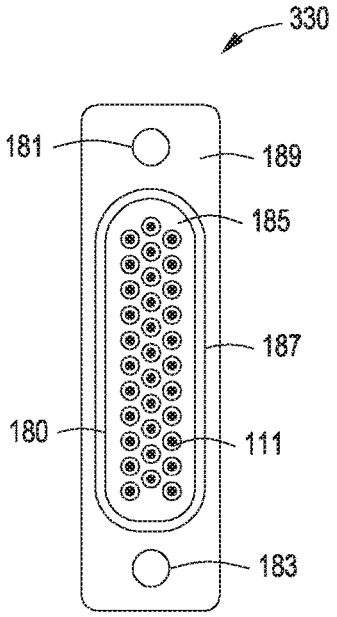
FIG. 9 depicts a plan view of another illustrative Micro-Miniature plug coupled to a faceplate and having an arrow-shaped interface, according to one or more embodiments described.
Figure 10:
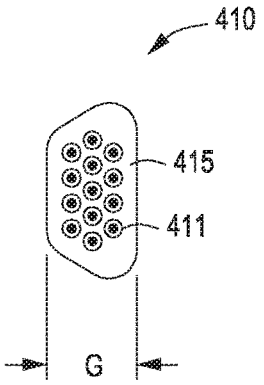
FIGS. 10-15 depict plan views of illustrative Micro-Miniature-D receptacles having 13, 22, 31, 37, 46, and 55 sockets, respectively, disposed in an interface thereof, according to one or more embodiments described.
Figure 11:
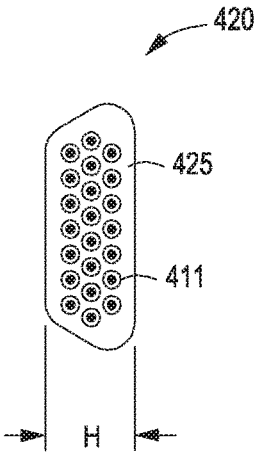
Figure 12:
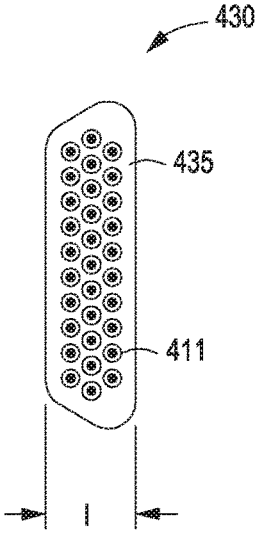
Figure 13:
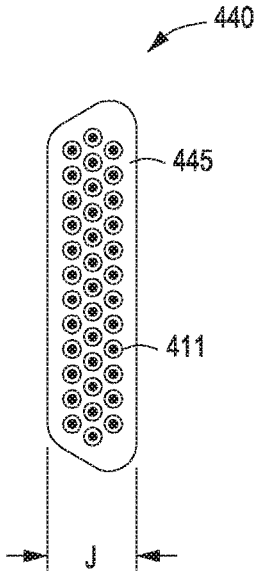
Figure 14:
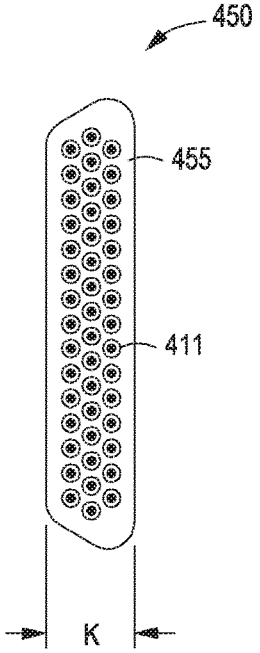
Figure 15:
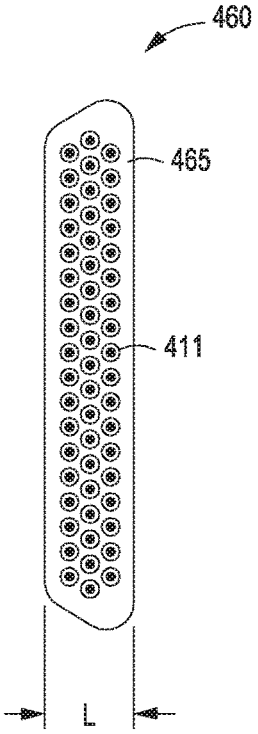

FIGS. 7-9 depict plan views of illustrative Micro-D plugs 130, 170, and 180 coupled to a faceplate 139, 179, and 189, respectively, according to one or more embodiments. The faceplates 139, 179, and 189 can include one or more holes, apertures, or other openings 131, 133, 171, 173, 181, or 183 that can be used to couple or secure the faceplate 139, 179, and 189 to a body or structure via a screw, pin, or other connector. The plugs 130, 170, and 180 can each include a housing or shell 137, 177, and 187, respectively, and the interface 135 depicted in FIG. 3, an interface 175, and an interface 185, respectively, at least partially disposed therein. It should be noted that the plugs 110, 120, 140, 150, and 160 discussed and described above with reference to FIGS. 1, 2 and 4-6 can also each include housings or shells similar to the housings or shells, 137, 177, and 187, with the interfaces 115, 125, 145, 155, and 165 at least partially disposed therein. It should also be noted that the plugs 110, 120, 140, 150, and 160 discussed and described above with reference to FIGS. 1, 2 and 4-6 can also be coupled to faceplates similar to faceplates 139, 179, and 189.

It should be noted that the interfaces 115, 125, 135, 145, 155, and 165 can be a variety of shapes, including arrow-shaped, polygon-shaped, and elliptical-shaped. Illustrative polygon-shaped interfaces can include, but are not limited to, triangles, quadrilaterals, pentagons, hexagons, heptagons, octagons, nonagons, and decagons. Illustrative quadrilateral-shaped plug interfaces can include, but are not limited to, rectangular-shaped, rhombus-shaped, parallelogram-shaped, trapezoid-shaped, kite-shaped, and trapezium-shaped. For example, arrow-shaped plug interfaces 175 and 185 are shown in FIGS. 8 and 9. Similar to the interfaces 115, 125, 135, 145, 155, and 165 discussed and described above with reference to FIGS. 1-6, the plurality of pins 111 extending from the interfaces 175 and 185 can also be arranged in three, four, five, six, or more rows along a longitudinal axis thereof. In some examples, the plurality of pins 111 extending from the interfaces 175 and 185 can be arranged in three, four, five, six, or more substantially parallel rows along a longitudinal axis thereof.

The spacing between pins 111 of the plugs 110, 120, 130, 140, 150, 160, 170, and 180, measured as the distance between a center-point of any two adjacent pins 111 of the plurality of pins 111 can be about 0.045 inches, about 0.047 inches, or about 0.049 inches to about 0.51 inches, about 0.53 inches, or about 0.055 inches. In some examples, the spacing between pins 111 of the plugs 110, 120, 130, 140, 150, 160, 170, and 180, measured as the distance between a center-point of any two adjacent pins 111 of the plurality of pins 111 can be about 0.05 inches. In some examples, the pins 111 can have a diameter or about 0.01 inches, about 0.015 inches, about 0.020 inches, or about 0.025 inches to about 0.03 inches, about 0.035 inches, or about 0.04 inches. A distance from the interface 115, 125, 135 145, 155, or 165 to a tip of a pin 111 can be about 0.03 inches to about 0.235 inches. For example, the distance from the interface 115, 125, 135, 145, 155, or 165 to a tip of a pin 111 can be about 0.03 inches, about 0.07 inches, or about 0.09 inches to about 0.125 inches, about 0.2 inches, or about 0.235 inches. Further, as depicted in FIGS. 7-9, the faceplates 139, 179, and 189 can be used to secure the plugs 130, 170, and 180 to a corresponding receptacle.

The interfaces 115, 125, 135, 145, 155, or 165 can have a width A, B, C, D, E, or F, respectively, of about 0.18 inches, about 0.185 inches, or about 0.19 inches to about 0.22 inches, about 0.24 inches, about 0.26 inches, or about 0.28 inches. In some examples, plugs having at least three rows of pins 111 can have a width A, B, C, D, E, or F of about 0.18 inches to about 0.19 inches, e.g., about 0.185 inches. In other examples, plugs having at least three rows of pins 111 can have a width A, B, C, D, E, or F of about 0.18 inches to about 0.19 inches, e.g., about 0.185 inches, and a plug density of at least 240 pins/$in^2$, at least 255 pins/$in^2$, at least 270 pins/$in^2$, at least 280 pins/$in^2$, about 284 pins/$in^2$, about 290 pins/$in^2$, about 297 pins/$in^2$, or about 301 pins/$in^2$ to about 305 pins/$in^2$, about 310 pins/$in^2$, about 315 pins/$in^2$, about 320 pins/$in^2$ or more. In some examples, plugs having at least four rows of pins 111 can have a width of about 0.22 inches to about 0.23 inches, e.g., about 0.228 inches. In some examples, plugs having at least five rows of pins 111 can have a width of about 0.26 inches to about 0.27 inches, e.g., about 0.271 inches.

In some examples, the plugs 110, 120, 130, 140, 150, 160, 170, and 180 discussed and described above with reference to FIGS. 1-9 can have an all plastic-body (Class P connectors). In other examples, the plugs 110, 120, 130, 140, 150, 160, 170, and 180 can have a metal housing or shell with a plastic insulator (Class M connectors). In some examples, the plugs 110, 120, 130, 140, 150, 160, 170, and 180 can be located at a terminal end of a cable. In other examples, the plugs 110, 120, 130, 140, 150, 160, 170, and 180 can be installed onto a printed circuit board (PCB) or other structure.

The housings or shells 137, 177, and 187 can be fabricated from a variety of materials that can include, but are not limited to, aluminum type A380 in accordance with ASTM B85/85M-14, bar stock aluminum in accordance with ASTM B 221-14, aluminum alloy 2024 in accordance with SAE AMS-QQ-A-250/4B (Stabilized Feb. 5, 2015), aluminum alloy 6061 in accordance with SAE AMS-11-A-200/8A (Stabilized May 2015), aluminum alloy 7075 in accordance with SAE AMS-QQ-A-200/11A (Stabilized October 2014) or SAE AMS-QQ-A-250/12A (Stabilized December 2013), or 300 series stainless steel passivated in accordance with SAE AMS-2700E, type 2 (Revised Nov. 22, 2011). In other examples, the housings or shells 137, 177, and 187 can be fabricated from cadmium, zinc nickel, nickel, silver, copper, iron, gold, platinum, palladium, alloys thereof, oxides thereof, or any combination thereof.

The housings or shells 137, 177, and 187 can also include metallic finish, including, but not limited to, pure electrodeposited aluminum in accordance with MIL-DTL-83488D (Rev. Apr. 1, 1999), type II, non-reflective color; cadmium deposited in accordance with SAE-AMS-QQ-P-416E (Revised Jan. 13, 2016), type II, class 3; zinc nickel in accordance with ASTM B841-99 (2010); or electroless nickel deposited in accordance with SAE AMS2404G (Revised Dec. 12, 2013); and/or passivated stainless steel. In other examples, the metallic finish can be or include a nickel fluorocarbon polymer.

The plug interfaces 115, 125, 135, 145, 155, 165, 175, and 185 can be fabricated from a variety of materials that can include, but are not limited to, glass filled thermoplastic materials in accordance with ASTM D5927-14, or liquid crystal polymer (LCP) in accordance with ASTM 5138-16. In other examples, Class P plugs, including the interfaces 115, 125, 135, 145, 155, 165, 175, and 185 and the housings or shells 137, 177, and 187, can be fabricated from plastic materials that can include, but are not limited, to polyphenylene sulfide, polyamide 6, polyamide 66, polyamide polyamide 11, polyamide 12, polybutylene terephthalate, polyphthalamide, or any combination thereof.

FIGS. 10-15 depict plan views of illustrative Micro-D receptacles 410, 420, 430, 440, 450, and 460, respectively, according to one or more embodiments. The receptacles 410, 420, 430, 440, 450, and 460, respectively, can include an interface 415, 425, 435, 445, 455, and 465, respectively, which can include a plurality of sockets 411 disposed therein. For example, as shown in FIGS. 10-15, the Micro-D receptacles 410, 420, 430, 440, 450, and 460 can include thirteen (13), twenty-two (22), thirty-one (31), thirty-seven (37), forty-six (46), and fifty-five (55) sockets 411 disposed therein, respectively. The plurality of sockets 411 can be arranged in three, four, five, six, or more rows along a longitudinal axis of each interface 415, 425, 435, 445, 455, and 465. In some examples, the plurality of sockets 411 can be arranged in three, four, five, six, or more substantially parallel or parallel rows along a longitudinal axis of the respective interface 415, 425, 435, 445, 455, and 465. The number of sockets 411 in any two adjacent rows can be the same or different with respect to one another.

In some examples, the number of sockets 411 in a receptacle, e.g., the receptacles 410, 420, 430, 440, 450, and 460, that includes three rows of sockets 411 along the longitudinal axis thereof, can correspond to the following equation: $B_{3\text{-}row}=S_{2\text{-}row}+((S_{2\text{-}row}-1)/2)$, where $B_{3\text{-}row}$ is the number of sockets in a receptacle having three rows, and where $S_{2\text{-}row}$ is the number of sockets in a standard connector having two rows of socks and defined according to MIL-DTL-83513/4J Mar. 6, 2009 (Class M) or MIL-DTL-83513/9F w/Amendment 2: Dec. 14, 2011 (Class P). In other examples, the number of sockets 411 in a receptacle that includes four rows of sockets 411 along the longitudinal axis thereof can correspond to the following equation: $B_{4\text{-}row}=(4 S_{3\text{-}row})/3)$, where $B_{4\text{-}row}$ is the number of sockets in a receptacle having four rows, and where $S_{3\text{-}row}$ is the number of sockets in a standard connector having three rows of sockets and defined according to MIL-DTL-83513/4J Mar. 6, 2009 (Class M) or MIL-DTL-83513/9F w/Amendment 2: Dec. 14, 2011 (Class P). In other examples, the number of sockets 411 in a receptacle that includes five rows of sockets 411 along the longitudinal axis thereof can correspond to the following equation: $B_{5\text{-}row}=S_{4\text{-}row}+((S_{4\text{-}row}-1)/2)$, where $B_{5\text{-}row}$ is the number of sockets in a receptacle having five rows, and where $S_{4\text{-}row}$ is the number of sockets in a standard connector having four rows of sockets and defined according to MIL-DTL-83513/4J Mar. 6, 2009 (Class M) or MIL-DTL-83513/9F w/Amendment 2: Dec. 14, 2011 (Class P).

In some examples, the receptacles 410, 420, 430, 440, 450, and 460 having at least three rows of sockets 411, as depicted in FIGS. 10-15, can have a receptacle area of about 0.05 $in^2$, about 0.1 $in^2$, about 0.12 $in^2$, about 0.14 $in^2$, about 0.16 $in^2$, or about 0.18 $in^2$ to about 0.2 $in^2$, about 0.4 $in^2$, about 0.6 $in^2$, about 0.8 $in^2$, about 1 $in^2$, about 2 $in^2$, about 3 $in^2$, about 4 $in^2$, about 5 $in^2$, or more. In some examples, the receptacles 410, 420, 430, 440, 450, and 460 having at least three rows of sockets 411, can have a receptacle density of at least 280 sockets/$in^2$, about 284 sockets/$in^2$, about 290 sockets/$in^2$, about 297 sockets/$in^2$, or about 301 sockets/$in^2$ to about 305 sockets/$in^2$, about 310 sockets/$in^2$, about 315 sockets/$in^2$, about 320 sockets/$in^2$ or more. It should be noted that the receptacle interfaces 415, 425, 435, 445, 455, and 465 can also correspond to various other receptacles, including, but not limited to Nano-Miniature receptacles, e.g., nano-D receptacles. It should also be noted that the receptacle interfaces 415, 425, 435, 445, 455, and 465 can also correspond to various other receptacles that are not defined according to a military standard specification, but can be defined according to "non-military standard" specifications.

In other examples, a receptacle having at least four rows of sockets can have at least twenty-four (24) sockets, at least thirty-six (36) sockets, at least sixty-eight (68) sockets, or at least ninety-two (92) sockets. The receptacle having at least four rows of sockets can have a receptacle area of about 0.05 $in^2$, about 0.08 $in^2$, about 0.11 $in^2$, or about 0.2 $in^2$ to about 0.27 $in^2$, about 0.5 $in^2$, about 1 $in^2$, about 2 $in^2$, about 3 $in^2$, or more. The receptacles can have a receptacle density of at least 280 sockets/$in^2$, about 283 sockets/$in^2$, about 292 sockets/$in^2$, about 303 sockets/$in^2$ or about 310 sockets/$in^2$ to about 315 sockets/$in^2$, about 320 sockets/$in^2$, about 324 sockets/$in^2$, 330 sockets/$in^2$ or more.

In other examples, a receptacle having at least five rows of sockets can have about fifty-nine (59) sockets, about one hundred twenty-nine (129) sockets, or more. The receptacles can have a receptacle area about 0.17 $in^2$, about 0.36 $in^2$, about 0.5 $in^2$, about 1 $in^2$, or about 1.5 $in^2$ to about 2 $in^2$, about 2.5 $in^2$, about 3 $in^2$, about 3.5 $in^2$, or more. The receptacles can have a receptacle density of at least 280 sockets/$in^2$, about 310 sockets/$in^2$, or about 320 sockets/$in^2$ to about 332 sockets/$in^2$, about 340 sockets/$in^2$, about 351 sockets/$in^2$, or more.

Figure 16:
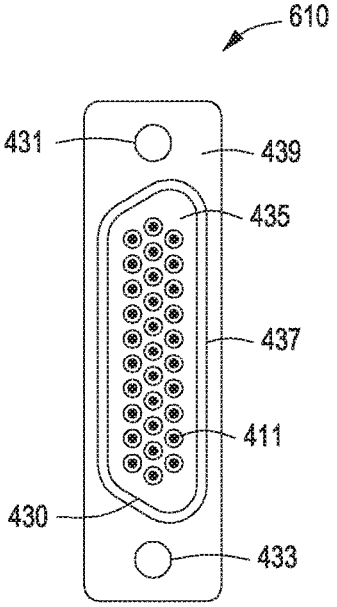
FIG. 16 depicts a plan view of an illustrative Micro-Miniature-D receptacle coupled to a faceplate, according to one or more embodiments described.
Figure 17:
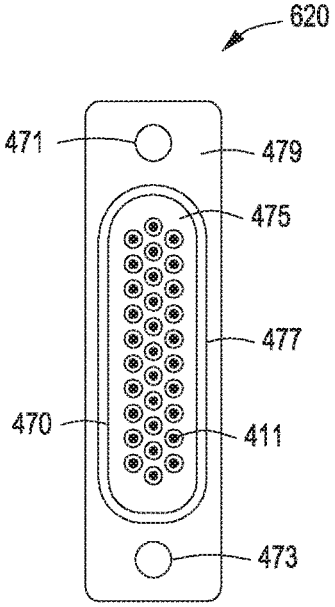
FIG. 17 depicts a plan view of an illustrative Micro-Miniature receptacle coupled to a faceplate and having an arrow-shaped interface, according to one or more embodiments described.
Figure 18:
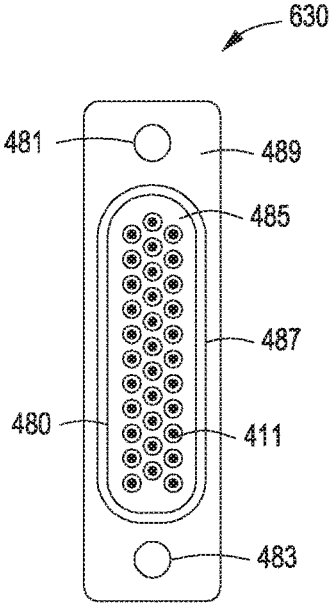
FIG. 18 depicts a plan view of another illustrative Micro-Miniature receptacle coupled to a faceplate and having an arrow-shaped interface, according to one or more embodiments described.

FIGS. 16-18 depict plan views of illustrative Micro-D receptacles 430, 470, and 480 coupled to a faceplate 439, 479, and 489, respectively, according to one or more embodiments. The faceplates 139, 479, and 489 can include one or more holes, apertures, or other openings 431, 433, 471, 473, 481, or 483 that can be used to facility coupling or securing the faceplate 439, 479, and 489 to a body or structure via of a screw, pin, or other connector. The receptacles 430, 470, and 480 can each include a housing or shell 437, 477, and 487, respectively, and the interface 435 depicted in FIG. 12, an interface 475, and an interface 485, respectively, at least partially disposed therein. It should be noted that the receptacles 410, 420, 440, 450, and 460 discussed and described above, with reference to FIGS. 10, 11 and 13-15 can also each include housings or shells similar to the housings or shells 437, 477, and 487, with the interfaces 415, 425, 445, 455, and 465 at least partially disposed therein. It should also be noted that the receptacles 410, 420, 440, 450, and 460 discussed and described above with reference to FIGS. 10, 11 and 13-15 can also be coupled to faceplates similar to the faceplates 439, 479, and 489.

It should be noted that receptacle interfaces can be a variety of shapes, including arrow-shaped, polygon-shaped, and elliptical-shaped. Illustrative polygon-shaped receptacle interfaces can include, but are not limited to, triangles, quadrilaterals, pentagons, hexagons, heptagons, octagons, nonagons, and decagons. Illustrative quadrilateral-shaped receptacle interfaces can include, but are not limited to, rectangular-shaped, rhombus-shaped, parallelogram-shaped, trapezoid-shaped, kite-shaped, and trapezium-shaped. For example, arrow-shaped receptacle interfaces 475 and 485 are shown in FIGS. 17 and 18. Similar to the interfaces 415, 425, 435, 445, 455, and 465 discussed and described above with reference to FIGS. 10-15, the plurality of sockets 411 that can be disposed therein can also be arranged in three, four, five, six, or more rows along a longitudinal axis thereof. The plurality of sockets 411 disposed within the interfaces 475 and 485 can also be arranged in three, four, five, six, or more parallel rows along a longitudinal axis thereof.

The spacing between the sockets 411 of the receptacles 410, 420, 430, 440, 450, 460, 470, and 480, measured as the distance between a center-point of any two adjacent sockets 411 of the plurality of sockets 411 can be about 0.045 inches, about 0.047 inches, or about 0.049 inches to about 0.51 inches, about 0.53 inches, or about 0.055 inches. In some examples, the spacing between the sockets 411 of the receptacles 410, 420, 430, 440, 450, 460, 470, and 480, measured as the distance between a center-point of any two adjacent sockets 411 of the plurality of sockets 411 can be about 0.05 inches. In some examples, the sockets 411 can have a diameter of about 0.01 inches, about 0.015 inches, about 0.02 inches, or about 0.25 inches to about 0.03 inches, about 0.035 inches, or about 0.04 inches. Further, as depicted in FIGS. 16-18, the faceplates 439, 479, and 489 can be used to secure the receptacles 430, 470, and 480 to a corresponding plug.

The interfaces 415, 425, 435, 445, 455, and 465 can have a width G, H, I, J, K, or L, respectively, of about 0.18 inches, about 0.185 inches, or about 0.19 inches to about 0.22 inches, about 0.24 inches, about 0.26 inches, or about 0.28 inches. In some examples, receptacles 410, 420, 430, 440, 450, and 460 having at least three rows of sockets 411 can have a width G, H, I, J, K, or L of about 0.18 inches to about 0.19 inches, e.g., about 0.185 inches. In other examples, receptacles 410, 420, 430, 440, 450, and 460 having at least three rows of sockets 411 can have a width G, H, I, J, K, or L of about 0.18 inches to about 0.19 inches, e.g., about 0.185 inches, and a receptacle density of at least 240 sockets/in$^2$, at least 255 sockets/in$^2$, at least 270 sockets/in$^2$, at least 280 sockets/in$^2$, about 284 sockets/in$^2$, about 290 sockets/in$^2$, about 297 sockets/in$^2$, or about 301 sockets/in$^2$ to about 305 sockets/in$^2$, about 310 sockets/in$^2$, about 315 sockets/in$^2$, about 320 sockets/in$^2$ or more. In some examples, receptacles having at least four rows of sockets 411 can have a width of about 0.22 inches to about 0.23 inches, e.g., about 0.228 inches. In some examples, receptacles having at least five rows of sockets 411 can have a width of about 0.26 inches to about 0.28 inches, e.g., about 0.271 inches.

In some examples, the receptacles 410, 420, 430, 440, 450, 460, 470, and 480 discussed and described above, with reference to FIGS. 10-18 can have an all plastic-body (Class P connectors). In other examples, the receptacles 410, 420, 430, 440, 450, 460, 470, and 480 can have a metal housing or shell with a plastic insulator (Class M connectors). In some examples, the receptacles 410, 420, 430, 440, 450, 460, 470, and 480 can be located at a terminal end of a cable. In other examples, the receptacles 410, 420, 430, 440, 450, 460, 470, and 480 can be installed onto a printed circuit board (PCB) or other structure.

The housings or shells 437, 477 and 487 can be fabricated from a variety of materials that can include, but are not limited to, aluminum type A380 in accordance with ASTM B85/85M-14, bar stock aluminum in accordance with ASTM B 221-14, aluminum alloy 2024 in accordance with SAE AMS-QQ-A-250/4B (Stabilized Feb. 5, 2015), aluminum alloy 6061 in accordance with SAE AMS-11-A-200/8A (Stabilized May 2015), aluminum alloy 7075 in accordance with SAE AMS-QQ-A-200/11A (Stabilized October 2014) or SAE AMS-QQ-A-250/12A (Stabilized December 2013), or 300 series stainless steel passivated in accordance with SAE AMS-2700E, type 2 (Revised Nov. 22, 2011). Additional, the housing or shell 437, 477, 487 components can be fabricated from cadmium, zinc nickel, nickel, silver, copper, iron, gold, platinum, palladium, alloys thereof, oxides thereof, or any combination thereof.

The housings or shells 437, 477 and 487 can also include a metallic finish, including, but not limited to, pure electrodeposited aluminum in accordance with MIL-DTL-83488D (Rev. Apr. 1, 1999), type II, non-reflective color; cadmium deposited in accordance with SAE-AMS-QQ-P-416E (Revised Jan. 13, 2016), type II, class 3; zinc nickel in accordance with ASTM B841-99 (2010); or electroless nickel deposited in accordance with SAE AMS2404G (Revised Dec. 12, 2013); passivated stainless steel. In other examples, the metallic finish can be or include a nickel fluorocarbon polymer.

The receptacle interfaces 415, 425, 435, 445, 455, 465, 475, and 485 can be fabricated from a variety of materials that can include, but are not limited to, glass filled thermoplastic materials in accordance with ASTM D5927-14, or liquid crystal polymer (LCP) in accordance with ASTM 5138-16. In other examples, Class P receptacles, including interfaces 415, 425, 435, 445, 455, 465, 475, and 485 and housings or shells 437, 477, and 487, can be fabricated from plastic materials that can include, but are not limited to, polyphenylene sulfide, polyamide 6, polyamide 66, polyamide 11, polyamide 12, polybutylene terephthalate, polyphthalamide, or any combination thereof.

In one or more examples, an electrical connector assembly can include a plug, e.g., plug 110, 120, 130, 140, 150, 160, 170, and/or 180 discussed and described above with reference to FIGS. 1-9, as well as other examples discussed above, and a receptacle, e.g., the receptacle 410, 420, 430, 440, 450, 460, 470, and/or 480 discussed and described above with reference to FIGS. 10-18, as well as other examples discussed above. For example, the plug 110 and the receptacle 410 can be coupled or otherwise connected to one another to provide an electrical connector assembly. The interface 115 of the plug 110 can be referred to as a "first" interface and the interface 415 of the receptacle 410 can be referred to as a "second" interface. Similar terminology can be applied to the additional plugs 120, 130, 140, 150, 160, 170, and 180 and the additional receptacles 420, 430, 440, 450, 460, 470, and 480 and other plugs and receptacles discussed above.

The plurality of pins 111 extending from an interface of a plug can be or include one or more electrical contacts. Similarly, the plurality of sockets disposed within an interface of a receptacle can also be or include one or more electrical contacts. The plurality of pins 111 of the plugs, e.g., 110, 120, 130, 140, 150, 160, 170, and 180 discussed and described above with reference to FIGS. 1-9, can be inserted into the corresponding plurality of sockets 411 of the receptacles, e.g., 410, 420, 430, 440, 450, 460, 470, and 480 discussed and described above with reference to FIGS. 10-18, to form or otherwise provide an electrical connection between the corresponding plurality of pins 111 and plurality of sockets 411. In some examples, the electrical connection can also be an optical or other type of connection. In some examples, the connection, e.g., electrical and/or optical connection, formed between the corresponding plurality of pins 111 and the plurality of sockets 411 can connect downhole tools and assemblies to surface systems. In other examples, the plugs 110, 120, 130, 140, 150, 160, 170, and 180, receptacles 410, 420, 430, 440, 450, 460, 470, and 480, and electrical connector assemblies, discussed and described above, can be used in missiles and missile guidance systems, aerospace avionics, radar systems, shoulder-launched weapon systems, advanced soldier technology systems, military Global Positioning Systems, satellites, and medical devices.

Embodiments of the present disclosure further relate to any one or more of the following paragraphs:

1. A plug comprising an interface having a plurality of pins extending therefrom, wherein the plug has a plug density of at least 280 pins/in$^2$, and wherein the plurality of pins is positioned in at least three rows along a longitudinal axis of the interface.

2. The plug according to paragraph 1, wherein the at least three rows along the longitudinal axis of the interface are substantially parallel with respect to one another.

3. The plug according to paragraph 1 or 2, wherein a surface area of the interface from which the plurality of pins extend is about 0.08 in$^2$ to about 0.37 in$^2$.

4. The plug according to any one of paragraphs 1 to 3, wherein a distance between a center-point of any two adjacent pins of the plurality of pins is about 0.045 inches to about 0.055 inches.

5. The plug according to any one of paragraphs 1 to 4, wherein a surface area and a shape of the interface is substantially the same as an interface of a Nano-Miniature plug.

6. The plug according to any one of paragraphs 1 to 5, wherein a surface area and a shape of the interface is substantially the same as an interface of a Micro-Miniature-D plug.

7. The plug according to any one of paragraphs 1 to 6, wherein the interface has a width of about 0.18 inches to about 0.19 inches, and wherein the plurality of pins comprises 31, 37, 46, or 55 pins.

8. The plug according to any one of paragraphs 1 to 6, wherein the interface has a width of about 0.22 inches to about 0.23 inches, and wherein the plurality of pins comprises 24, 36, 68, or 92 pins.

9. The plug according to any one of paragraphs 1 to 6, wherein the interface has a width of about 0.26 inches to about 0.28 inches, and wherein the plurality of pins comprises 59 or 129 pins.

10. The plug according to any one of paragraphs 1 to 6, wherein the interface has a width of about 0.185 inches, wherein the plug has a plug density of at least 280 pins/in$^2$ to about 325 pins/in$^2$, and wherein the plurality of pins is positioned in three substantially parallel rows along the longitudinal axis of the interface.

11. The plug according to any one of paragraphs 1 to 6, wherein the interface has a width of about 0.288 inches, wherein the plug has a plug density of at least 280 pins/in$^2$ to about 335 pins/in$^2$, and wherein the plurality of pins is positioned in four substantially parallel rows along the longitudinal axis of the interface.

12. The plug according to any one of paragraphs 1 to 6, wherein the interface has a width of about 0.271 inches, wherein the plug has a plug density of at least 280 pins/in$^2$ to about 355 pins/in$^2$, and wherein the plurality of pins is positioned in five substantially parallel rows along the longitudinal axis of the interface.

13. The plug according to any one of paragraphs 1 to 9, wherein the plug has a plug density of at least 280 pins/in$^2$ to about 355 pins/in$^2$.

14. A receptacle comprising an interface having a plurality of sockets disposed therein, wherein the receptacle has a receptacle density of at least 280 sockets/in$^2$, and wherein the plurality of sockets is positioned in at least three rows along a longitudinal axis of the interface.

15. The receptacle according to paragraph 14, wherein the at least three rows along the longitudinal axis of the interface are substantially parallel with respect to one another.

16. The receptacle according to paragraph 14 or 15, wherein a surface area of the interface in which the plurality of sockets is disposed is about 0.08 in$^2$ to about 0.37 in$^2$.

17. The receptacle according to any one of paragraphs 14 to 16, wherein a distance between a center-point of any two adjacent sockets of the plurality of sockets is about 0.045 inches to about 0.055 inches.

18. The receptacle according to any one of paragraphs 14 to 17, wherein a surface area and a shape of the interface is substantially the same as an interface of a Nano-Miniature receptacle.

19. The receptacle according to any one of paragraphs 14 to 18, wherein a surface area and a shape of the interface is substantially the same as an interface of a Micro-Miniature-D receptacle.

20. The receptacle according to any one of paragraphs 14 to 19, wherein the plurality of sockets is configured to receive a plurality of pins extending from an interface of a plug.

21. The receptacle according to any one of paragraphs 14 to 20, wherein the interface has a width of about 0.18 inches to about 0.19 inches, and wherein the plurality of sockets comprises 31, 37, 46, or 55 sockets.

22. The receptacle according to any one of paragraphs 14 to 20, wherein the interface has a width of about 0.22 inches to about 0.23 inches, and wherein the plurality of sockets comprises 24, 36, 68, or 92 sockets.

23. The receptacle according to any one of paragraphs 14 to 20, wherein the interface has a width of about 0.26 inches to about 0.28 inches, and wherein the plurality of sockets comprises 59 or 129 sockets.

24. The receptacle according to any one of paragraphs 14 to 20, wherein the interface has a width of about 0.185 inches, wherein the receptacle has a receptacle density of at least 280 receptacles/in$^2$ to about 325 receptacles/in$^2$, and wherein the plurality of receptacles is positioned in three substantially parallel rows along the longitudinal axis of the interface.

25. The receptacle according to any one of paragraphs 14 to 20, wherein the interface has a width of about 0.288 inches, wherein the receptacle has a receptacle density of at least 280 receptacles/in$^2$ to about 335 receptacles/in$^2$, and wherein the plurality of receptacles is positioned in four substantially parallel rows along the longitudinal axis of the interface.

26. The receptacle according to any one of paragraphs 14 to 20, wherein the interface has a width of about 0.271 inches, wherein the receptacle has a receptacle density of at least 280 receptacles/in$^2$ to about 355 receptacles/in$^2$, and wherein the plurality of receptacle is positioned in five substantially parallel rows along the longitudinal axis of the interface.

27. The receptacle according to any one of paragraphs 14 to 26, wherein the receptacle has a receptacle density of at least 280 sockets/in$^2$ to about 355 sockets/in$^2$.

28. An electrical connector assembly comprising: a plug comprising a first interface having a plurality of pins extending therefrom, wherein the plug has a plug density of at least 280 pins/in$^2$, and wherein the plurality of pins is positioned in at least three rows along a longitudinal axis of the first interface; and a receptacle comprising a second interface having a plurality of sockets disposed therein, wherein the receptacle has a receptacle density of at least 280 sockets/in$^2$, and wherein the plurality of sockets is positioned in at least three rows along a longitudinal axis of the second interface.

29. The electrical connector assembly according to paragraph 28, wherein the at least three rows along the longitudinal axis of the first interface are parallel with respect to one another.

30. The electrical connector assembly according to paragraph 28 or 29, wherein the at least three rows along a longitudinal axis of the second interface are parallel with respect to one another.

31. The electrical connector assembly according to any one of paragraphs 28 to 30, wherein a surface area of the first interface from which the plurality of pins extends and a surface area of the second interface in which the plurality of sockets is disposed are each about 0.08 in$^2$ to about 0.37 in$^2$.

32. The electrical connector assembly, according to any one of paragraphs 28 to 31, wherein a distance between a center-point of any two adjacent pins of the plurality of pins is about 0.045 inches to about 0.055 inches.

33. The electrical connector assembly, according to any one of paragraphs 28 to 32, wherein a distance between a center-point of any two adjacent sockets of the plurality of sockets is about 0.045 inches to about 0.055 inches.

34. The electrical connector assembly according to any one of paragraphs 28 to 33, wherein the plug has a plug density of at least 280 pins/in$^2$ to about 355 pins/in$^2$, and wherein the receptacle has a receptacle density of at least 280 sockets/in$^2$ to about 355 sockets/in$^2$.

Although the preceding description has been described herein with reference to particular means, materials, and embodiments, it is not intended to be limited to the particulars disclosed herein; rather, it extends to all functionally equivalent structures, processes, and uses, such as are within the scope of the appended claims.

Certain embodiments and features have been described using a set of numerical upper limits and a set of numerical lower limits. It should be appreciated that ranges including the combination of any two values, e.g., the combination of any lower value with any upper value, the combination of any two lower values, and/or the combination of any two upper values are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. And if applicable, all patents, test procedures, and other documents cited in this application are fully incorporated by reference to the extent such disclosure is not inconsistent with this application and for all jurisdictions in which such incorporation is permitted.

While the foregoing is directed to certain illustrative embodiments, other and further embodiments can be devised without departing from the basic scope thereof, and the scope thereof is determined by the claims that follow.

What is claimed is:

1. A plug comprising an interface having a plurality of pins extending therefrom, wherein the plug has a plug density of at least 280 pins/in$^2$, and wherein the plurality of pins is positioned in at least three rows along a longitudinal axis of the interface, wherein a distance between a center-point of any two adjacent pins of the plurality of pins is about 0.045 inches to about 0.055 inches.

2. The plug of claim 1, wherein a surface area of the interface from which the plurality of pins extend is about 0.08 in$^2$ to about 0.37 in$^2$, and wherein the plug has a plug density of at least 280 pins/in$^2$ to about 355 pins/in$^2$.

3. The plug of claim 1, wherein a surface area and a shape of the interface is substantially the same as an interface of a Nano-Miniature plug.

4. The plug of claim 1, wherein a surface area and a shape of the interface is substantially the same as an interface of a Micro-Miniature-D plug.

5. The plug of claim 1, wherein the interface has a width of about 0.18 inches to about 0.19 inches, and wherein the plurality of pins comprises 31, 37, 46 or 55 pins.

6. The plug of claim 1, wherein the interface has a width of about 0.22 inches to about 0.23 inches, and wherein the plurality of pins comprises 24, 36, 68, or 92 pins.

7. The plug of claim 1, wherein the interface has a width of about 0.26 inches to about 0.28 inches, and wherein the plurality of pins comprises 59 or 129 pins.

8. A receptacle comprising an interface having a plurality of sockets disposed therein, wherein the receptacle has a receptacle density of at least 280 sockets/in$^2$, and wherein the plurality of sockets is positioned in at least three rows along a longitudinal axis of the interface, wherein a distance between a center-point of any two adjacent sockets of the plurality of sockets is about 0.045 inches to about 0.055 inches.

9. The receptacle of claim 8, wherein a surface area of the interface in which the plurality of sockets is disposed is about 0.08 $in^2$ to about 0.37 $in^2$, and wherein the receptacle has a receptacle density of at least 280 sockets/$in^2$ to about 355 sockets/$in^2$.

10. The receptacle of claim 8, wherein a surface area and a shape of the interface is substantially the same as an interface of a Nano-Miniature receptacle.

11. The receptacle of claim 8, wherein a surface area and a shape of the interface is substantially the same as an interface of a Micro-Miniature-D receptacle.

12. The receptacle of claim 8, wherein the plurality of sockets is configured to receive a plurality of pins extending from an interface of a plug.

13. The receptacle of claim 8, wherein the interface has a width of about 0.18 inches to about 0.19 inches, and wherein the plurality of sockets comprises 31, 37, 46 or 55 sockets.

14. The receptacle of claim 8, wherein the interface has a width of about 0.22 inches to about 0.23 inches, and wherein the plurality of sockets comprises 24, 36, 68, or 92 sockets.

15. The receptacle of claim 8, wherein the interface has a width of about 0.26 inches to about 0.28 inches, and wherein the plurality of sockets comprises 59 or 129 sockets.

16. An electrical connector assembly comprising:

a plug comprising a first interface having a plurality of pins extending therefrom, wherein the plug has a plug density of at least 280 pins/$in^2$, and wherein the plurality of pins is positioned in at least three rows along a longitudinal axis of the first interface; and a receptacle comprising a second interface having a plurality of sockets disposed therein, wherein the receptacle has a receptacle density of at least 280 sockets/$in^2$, and wherein the plurality of sockets is positioned in at least three rows along a longitudinal axis of the second interface, wherein a distance between a center-point of any two adjacent pins of the plurality of pins is about 0.045 inches to about 0.055 inches.

17. The electrical connector assembly of claim 16, wherein a surface area of the first interface from which the plurality of pins extends and a surface area of the second interface in which the plurality of sockets is disposed are each about 0.08 $in^2$ to about 0.37 $in^2$.

18. The electrical connector assembly of claim 16, wherein the plug has a plug density of at least 280 pins/$in^2$ to about 355 pins/$in^2$, and wherein the receptacle has a receptacle density of at least 280 sockets/$in^2$ to about 355 sockets/$in^2$.

* * * * *